US011492225B2

(12) United States Patent
Watanabe

(10) Patent No.: US 11,492,225 B2
(45) Date of Patent: Nov. 8, 2022

(54) COATING FILM TRANSFER TOOL

(71) Applicant: FUJICOPIAN CO., LTD., Osaka (JP)

(72) Inventor: Kazuya Watanabe, Osaka (JP)

(73) Assignee: FUJICOPIAN CO., LTD., Osaka (JP)

( * ) Notice: Subject to any disclaimer, the term of this patent is extended or adjusted under 35 U.S.C. 154(b) by 385 days.

(21) Appl. No.: 16/651,012

(22) PCT Filed: Dec. 22, 2017

(86) PCT No.: PCT/JP2017/046127
§ 371 (c)(1),
(2) Date: Mar. 26, 2020

(87) PCT Pub. No.: WO2019/064615
PCT Pub. Date: Apr. 4, 2019

(65) Prior Publication Data

US 2020/0299092 A1 Sep. 24, 2020

(30) Foreign Application Priority Data

Sep. 29, 2017 (JP) ..... JP2017-191575

(51) Int. Cl.
*B65H 18/10* (2006.01)
*B43L 19/00* (2006.01)
(Continued)

(52) U.S. Cl.
CPC ..... *B65H 18/10* (2013.01); *B43L 19/00* (2013.01); *B43M 11/06* (2013.01); *B65H 23/06* (2013.01);
(Continued)

(58) Field of Classification Search
None
See application file for complete search history.

(56) References Cited

U.S. PATENT DOCUMENTS 6,521,045 B1 * 2/2003 Koyama ..... B65H 37/007 156/577
7,063,120 B2 * 6/2006 Huthmacher ..... B65H 37/007 156/577
(Continued)

FOREIGN PATENT DOCUMENTS

JP H06-127774 A 5/1994
JP 3075335 U 2/2001
(Continued)

OTHER PUBLICATIONS

JP-2007084264-A, Stocking Repair Tool, Apr. 2007, Yamamoto, English Translation (Year: 2007).*
(Continued)

*Primary Examiner* — William A. Rivera
(74) *Attorney, Agent, or Firm* — WHDA, LLP

(57) ABSTRACT

The coating film transfer tool includes: a feeding core around which transfer tape is wound and that feeds a piece of transfer tape, the piece of transfer tape including a piece of base tape and a coating film that is provided on one surface of the piece of base tape; a transfer head that presses the coating film against a transfer target and transfers the coating film thereonto; a winding core that winds up the piece of base tape from which the coating film has been transferred; and an intermediate roller that rotates as the piece of transfer tape travels, in contact with a first surface of the piece of transfer tape fed from the feeding core, the first surface being a surface on which the coating film is not provided. A second surface of the intermediate roller is adhesive with respect to the first surface.

3 Claims, 11 Drawing Sheets

(51) Int. Cl.

| | |
|---|---|
| ***B43M 11/06*** | (2006.01) |
| ***B65H 23/06*** | (2006.01) |
| ***B65H 35/00*** | (2006.01) |

(52) U.S. Cl.
CPC ... *B65H 35/0033* (2013.01); *B65H 2301/412* (2013.01); *B65H 2402/41* (2013.01); *B65H 2701/377* (2013.01)

(56) References Cited

U.S. PATENT DOCUMENTS

| | | | | |
|---|---|---|---|---|
| 7,515,382 | B2 * | 4/2009 | Argumedo | G11B 15/67 242/615.4 |
| 2005/0072529 | A1 * | 4/2005 | Yonezawa | B65H 37/007 156/577 |
| 2006/0090857 | A1 * | 5/2006 | Watanabe | B65H 37/007 156/577 |
| 2017/0253455 | A1 * | 9/2017 | Watanabe | B65H 23/032 |
| 2017/0369267 | A1 * | 12/2017 | Fujisawa | B65H 37/007 |
| 2018/0370275 | A1 * | 12/2018 | Watanabe | B43K 24/082 |
| 2019/0010009 | A1 * | 1/2019 | Fujisawa | B65H 16/005 |

FOREIGN PATENT DOCUMENTS

| | | | | |
|---|---|---|---|---|
| JP | 2002-283795 | A | | 10/2002 |
| JP | 2006-240041 | A | | 9/2006 |
| JP | 2007-084264 | A | * | 4/2007 |
| JP | 2009-285883 | A | | 12/2009 |
| JP | 2011-56696 | A | | 3/2011 |
| JP | 2014-80285 | A | | 5/2014 |
| JP | 2014-136309 | A | | 7/2014 |
| JP | 2017-74677 | A | | 4/2017 |
| WO | WO 2018/012119 | | * | 1/2018 |

OTHER PUBLICATIONS

International Search Report dated Apr. 3, 2018, issued in counterpart application No. PCT/JP2017/046127, w/English translation (2 pages).
Written Opinion dated Apr. 3, 2018, issued in counterpart application No. PCT/JP2017/046127 (3 pages).
Office Action dated Aug. 3, 2021, issued in counterpart JP Application No. 2019-544211, with English Translation. (8 pages).
Extended (Supplementary) European Search Report dated Sep. 30, 2021, issued in counterpart EP Application No. 17927779.3 (32 pages).

* cited by examiner

II

IV

COATING FILM TRANSFER TOOL

TECHNICAL FIELD

The present invention relates to a coating film transfer tool for press-transferring a coating film for typo correction, an adhesive film for adhesion, a coating film for decoration, or the like to a transfer target.

BACKGROUND ART

FIG. 3 is a schematic diagram illustrating a configuration of a conventional coating film transfer tool 1. The coating film transfer tool 1 includes a case 5 and a cover (not shown) that covers an opening in the case 5. The case 5 includes spindles 12 and 14 provided inside thereof, and a feeding core 2 and a winding core 3 are held by the spindles 12 and 14 so as to be rotatable. Also, a transfer head 4 protrudes from the case 5 to the outside. The coating film transfer tool 1 is also provided with transfer tape T that includes base tape with a coating film applied on the surface thereof. Transfer tape T is wound around the feeding core 2. A piece of transfer tape T drawn out from the feeding core 2 is separated into a coating film and a piece of base tape at the transfer head 4. The coating film is transferred onto the transfer target, and only the piece of base tape is wound up around the winding core 3. A belt 7 is wound around the feeding core 2 and the winding core 3 so that the feeding core 2 and the winding core 3 rotate in conjunction with each other.

This coating film transfer tool 1 has a configuration in which, when the coating film is to be transferred, the cores 2 and 3 are rotated such that the winding speed of the piece of base tape is higher than the feeding speed of the piece of transfer tape T, and appropriate tension is applied to the piece of transfer tape T due to slip, which is provided between the members, absorbing the difference in speed. In the coating film transfer tool 1, appropriate tension is applied to the piece of transfer tape T so that the piece of transfer tape T is prevented from being loose. In a final phase of usage of the transfer tape, the outer diameter of the pancake of the transfer tape around the feeding core is small. Therefore, higher tension is applied to the piece of transfer tape T than in an initial phase of usage in which the outer diameter of the pancake of the transfer tape around the feeding core is large. In the final phase of usage, if tension applied to the piece of transfer tape T is too high, the user, when transferring a coating film to a transfer target, needs to press the transfer head against the transfer target with a strong force, to perform transfer work. Therefore, a weak user may be unable to press the transfer head against the transfer target with a sufficient force, unable to draw out a piece of transfer tape T at the transfer head, and accordingly be unable to transfer a coating film. Also, even if a weak user can transfer a coating film, a transfer failure may occur. For example, the force with which the transfer head presses the transfer target surface may be off-center, which may result in that a coating film on a portion of the piece of transfer tape T in the width direction thereof is not transferred onto the transfer target surface. Although it is possible to prevent such a transfer failure from occurring in the final phase of usage by reducing tension that is applied to the piece of transfer tape T in the final phase of use, such reduction causes the problem in which the tension applied to the piece of transfer tape T is too low in the initial phase of usage.

If the tension applied to the piece of transfer tape T is too low in the initial phase of usage, a problem arises in which the piece of transfer tape becomes loose in the initial phase of usage. If the piece of transfer tape becomes loose near the transfer head, a problem arises in which the coating film cannot be easily cut upon the completion of transfer, for example.

By setting the outer diameter of the feeding core to be sufficiently large, it is possible to reduce the ratio between the outer diameter of the pancake of the feeding core in the initial phase of usage and the outer diameter of the pancake in the final phase of usage. Therefore, even if high tension is applied to the piece of transfer tape T from the initial phase of usage, it is possible to suppress a change in the tension of the piece of transfer tape T from the initial phase of usage to the final phase of usage, and the tension of the piece of transfer tape does not become too high in the final phase of usage. However, if the outer diameter of the feeding core is increased, a problem arises in which the size of the coating film transfer tool will be large.

To solve such problems, Patent Literature 1 and Patent Literature 2 each propose a coating film transfer tool that is configured such that the distance between the respective spindles of the feeding core and the winding core can be reduced due to a pressing force applied to the transfer head. As the distance between the spindles of the cores is reduced, the tension of a belt that rotates the two cores in conjunction with each other decreases. In such a coating film transfer tool, the tension of the piece of transfer tape is alleviated upon the transfer head being pressed when a coating film is to be transferred. Therefore, the user can transfer it with a small pressing force.

However, the coating film transfer tools according to Patent Literature 1 and Patent Literature 2 need be provided with a complex mechanism in order to reduce the distance between the spindles of the feeding core and the winding core. Patent Literature 3 proposes a coating film transfer tool (hereinafter referred to as a coating film transfer tool Z) configured such that a change in the tension of the piece of transfer tape T from the initial phase of usage to the final phase of usage can be suppressed without such a complex mechanism. The coating film transfer tool Z is provided with a tape roller that is rotatably supported at a midpoint of a piece of tape (transfer tape) that extends from a tape supply reel (a piece of transfer tape wound around the feeding core so as to form a pancake shape) to the transfer head. The piece of tape is wound around at least a portion of the outer circumference of the tape roller, and the tape roller rotates together with the piece of tape due to a frictional force, as the piece of tape moves. Also, in the coating film transfer tool Z, a rotational force transmission mechanism is provided between the winding reel (the winding core) and the tape roller, and this rotational force transmission mechanism can transmit a rotational force no greater than a preset value.

In this way, the coating film transfer tool Z has a configuration in which a tape roller is provided separate from the tape supply reel, the tape roller is rotated due to the movement of a piece of tape, and the rotation of the tape roller is transmitted to the winding reel (the winding core) so that the piece of tape is wound up. The diameter of the tape roller does not change as a result of the use of a piece of tape. Therefore, in the coating film transfer tool Z, the force of drawing out a piece of tape (the tension of the piece of transfer tape) can be substantially kept at the same level, from the initial phase of usage to the final phase of usage.

CITATION LIST

Patent Literature

Patent Literature 1: JP 2002-283795A
Patent Literature 2: JP 2009-285883A
Patent Literature 3: JP 2006-240041A

SUMMARY OF INVENTION

Technical Problem

As disclosed in Patent Literature 3, in the coating film transfer tool Z, it is required that the resistance against the rotation of the tape supply reel when the piece of tape is drawn out is set to be extremely low. If the resistance against the rotation of the tape supply reel is high, the tension of a piece of transfer tape drawn out from the tape supply reel will be high. The tension of a piece of transfer tape is obtained by dividing the resistance against the rotation of the tape supply reel by the radius of the tape supply reel. Therefore, the tension of a piece of tape drawn out from the tape supply reel increases as the resistance against the rotation of the tape supply reel increases. Also, the tension of a piece of tape in the final phase of usage is larger than the tension of a piece of tape in the initial phase of usage. Therefore, if the resistance against the rotation of the tape supply reel is large, the tension of a piece of tape in the final phase of usage is a very large value, even in the case of the coating film transfer tool Z.

However, if the resistance against the rotation of the tape supply reel is set to be extremely low, the tape supply reel is easily rotated by an external force, and a piece of tape may become loose between the tape supply reel and the tape roller. If a piece of tape is loose, the piece of tape is not in contact with the tape roller. If the coating film transfer tool is used in such a state, the tape roller does not rotate at the beginning despite the user pressing a piece of tape with the transfer head to perform transfer work. In the coating film transfer tool Z, the winding reel (the winding core) is configured to rotate in conjunction with the tape roller, and therefore the winding reel (the winding core) does not rotate as the tape roller does not rotate. As a result, a piece of base tape remaining after a coating film has been transferred from the piece of tape at the transfer head is not wound up by the winding reel (the winding core), and becomes loose around the transfer head. If a piece of tape becomes loose around the transfer head, the piece of tape may be twisted or bent, and as a result, it may become impossible to nm the piece of tape.

The present invention aims to provide a coating film transfer tool that can suppress a change in the tension of a piece of transfer tape from the initial phase of usage to the final phase of usage of the coating film transfer tool without employing a complex structure, and does not allow the piece of transfer tape to cause a running failure as a result of becoming loose.

Solution to Problem

A coating film transfer tool according to a first aspect of the present invention includes: a feeding core around which transfer tape is wound and configured to feed a piece of transfer tape, the piece of transfer tape including a piece of base tape and a coating film that is provided on one surface of the piece of base tape; a transfer head configured to press the coating film against a transfer target and transfers the coating film thereonto; a winding core configured to wind up the piece of base tape from which the coating film has been transferred; and an intermediate roller configured to rotate as the piece of transfer tape travels, in contact with a first surface of the piece of transfer tape fed from the feeding core, the first surface being a surface on which the coating film is not provided. A second surface of the intermediate roller is adhesive with respect to the first surface, the second surface coming into contact with the piece of transfer tape.

A coating film transfer tool according to a second aspect of the present invention is the coating film transfer tool according to the first aspect, further including a belt that is wound around the intermediate roller and the winding core. The piece of base tape from which the coating film has been transferred is wound up by the winding core upon the intermediate roller and the winding core rotating in conjunction with each other due to the belt.

A coating film transfer tool according to a third aspect of the present invention is the coating film transfer tool according to the first aspect, wherein a 180° peel force of the first surface and the second surface is greater than or equal to 2 mN/8 mm.

A coating film transfer tool according to a fourth aspect of the present invention is the coating film transfer tool according to the second aspect, wherein a 180° peel force of the first surface and the second surface is greater than or equal to 2 mN/18 mm.

A coating film transfer tool according to a fifth aspect of the present invention is the coating film transfer tool according to the second aspect, wherein the belt is in contact with the feeding core, and the belt is configured to move in a direction opposite to a direction in which the feeding core moves, at a position where the belt is in contact with the feeding core, due to the coating film being transferred onto the transfer target by the transfer head.

A coating film transfer tool according to a sixth aspect of the present invention is the coating film transfer tool according to the fourth aspect, wherein the belt is in contact with the feeding core, and the belt is configured to move in a direction opposite to a direction in which the feeding core moves, at a position where the belt is in contact with the feeding core, due to the coating film being transferred onto the transfer target by the transfer head.

Advantageous Effects of Invention

As described above, with a coating film transfer tool according to the present invention, it is possible to suppress a change in the tension of a piece of transfer tape from the initial phase of usage to the final phase of usage of the coating film transfer tool, without employing a complex structure. Also, there is a very low possibility that looseness of a piece of transfer tape will cause a running failure of the piece of transfer tape.

DESCRIPTION OF EMBODIMENTS

Figure 1A:
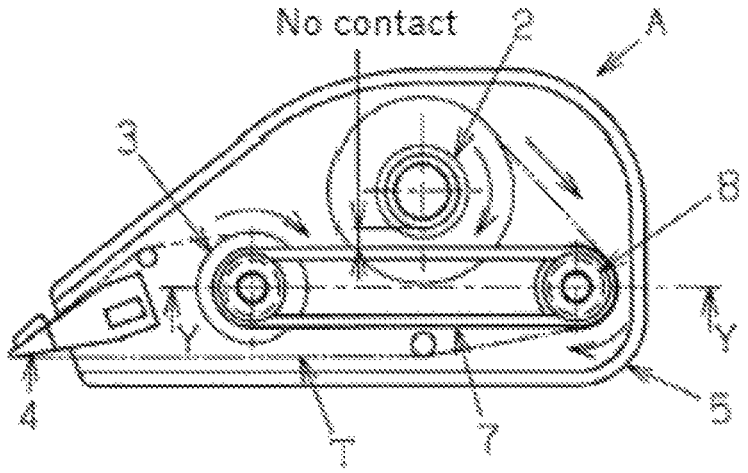
FIGS. 1A and 1B show a coating film transfer tool according to a first embodiment of the present invention.
Figure 1B:
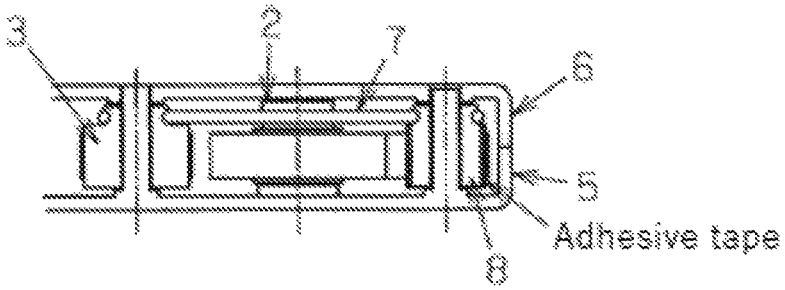

FIGS. 1A and 1B show a coating film transfer tool A according to a first embodiment of the present invention. FIG. 1A is a front view showing a state in which a cover has been removed. FIG. 1A shows a state in an initial phase of usage in which transfer tape T wound around a feeding core 2 is unused and the outer diameter of a feeding pancake is large. FIG. 1B is a cross-sectional view taken along a line Y-Y in FIG. 1A. Note that FIG. 1B shows a state in which the cover is attached.

The coating film transfer tool A includes a case 5, a cover 6, and transfer tape T that includes base tape with a coating film applied thereonto. The coating film transfer tool A also includes a feeding core 2 that winds a piece of transfer tape T, a transfer head 4 that transfers a coating film applied on the piece of transfer tape T to a transfer target such as a piece of paper, and a winding core 3 that winds up a piece of base tape after the coating film has been transferred. The coating film transfer tool A also includes an intermediate roller 8 that comes into contact with a piece of transfer tape T that is fed from the feeding core 2, and rotates as the piece of transfer tape T travels, and a belt 7 that is wound around the intermediate roller 8 and a pulley that is provided on the winding core 3, and transmits the rotation of the intermediate roller 8 to the winding core 3.

In the coating film transfer tool A, upon a coating film being transferred by the transfer head 4, the surface of the piece of transfer tape T fed from the feeding core 2 on which a coating film is not provided (hereinafter referred to as a back surface) comes into contact with the intermediate roller 8, and the intermediate roller 8 rotates as the piece of transfer tape T travels. If the piece of transfer tape T slips on the intermediate roller 8 and the circumferential length by which the outer circumference of the intermediate roller 8 rotates is shorter than the distance that the piece of transfer tape T travels, the winding core 3, which rotates in conjunction with the intermediate roller 8 due to the belt 7, will not be sufficiently rotated. If the winding core 3 is not sufficiently rotated, the piece of base tape is not wound up by the winding core 3 after the coating film has been transferred by the transfer head 4, and the piece of base tape becomes loose between the transfer head 4 and the winding core 3, which results in a running failure of the piece of transfer tape T and the piece of base tape after the coating film has been transferred.

Therefore, it is preferable that the intermediate roller 8 does not slip on the back surface of the piece of transfer tape T, and the outer circumference of the intermediate roller 8 rotates by the same length as the piece of transfer tape T travels. In order to prevent the intermediate roller 8 from slipping on the back surface of a piece of transfer tape T, it is preferable that the surface of the intermediate roller that comes into contact with the piece of transfer tape (hereinafter referred to as an outer circumferential surface of the intermediate roller) is adhesive with respect to the back surface of the piece of transfer tape. Any material may be used as the material that is adhesive with respect to the back surface of a piece of transfer tape T. For example, a material that contains silicone, urethane, acrylic, or any of various kinds of rubber may be used.

It is preferable that the adhesiveness of the outer circumferential surface of the intermediate roller 8 with respect to the back surface of a piece of transfer tape T satisfies the following conditions at the same time: areal-contactability with respect to the back surface of the piece of transfer tape T; easy peeling properties; and non-transferability of an adhesive. That is to say, in the state of being contact with the back surface of a piece of transfer tape T, the outer circumferential surface of the intermediate roller 8 needs to have areal-contactability with respect to the piece of transfer tape T so that the outer circumferential surface of the intermediate roller 8 does not slip on the back surface of the piece of transfer tape T and moves together with the piece of transfer tape T while the piece of transfer tape T travels, and the intermediate roller 8 rotates reliably. In contrast, when the piece of transfer tape T is peeled off from the outer circumferential surface of the intermediate roller 8, it is required that the outer circumferential surface of the intermediate roller 8 has easy peeling properties that allows the piece of transfer tape T to be easily peeled off, and properties with which an adhesive component is not transferred onto the back surface of the piece of transfer tape even after the piece of transfer tape is peeled off after it has adhered to the outer circumferential surface for a long time. Among the materials listed above, a silicone-containing material is preferable as the material of an adhesive that satisfies such properties at the same time, and an addition-curing silicone component is particularly preferable.

From the viewpoints of the above-described areal-contactability, easy peeling properties, and the non-transferability of the adhesive, it is preferable to employ a material that is mainly composed of silicone obtained by curing a silicone composition that contains diorganopolysiloxane having two or more alkenyl groups in one molecule, and organohydrogenpolysiloxane, through addition reaction in the presence of a platinum catalyst, as the addition-curing silicone component that is used in the outer circumferential surface of the intermediate roller 8. If adhesiveness is insufficient, an MQ resin may be added to the addition-curing silicone component. An MQ resin is a silicone resin that contains a siloxane unit that is represented as an M unit [$R_3SiO_{1/2}$ (where R is a monovalent hydrocarbon group)] and a siloxane unit that is represented as a Q unit [$SiO_{4-1/2}$]. An MQ resin may be used alone, or two or more types of MQ resins may be used in combination, and a D unit [$R_2SiO_{2-1/2}$ (where R is a monovalent hydrocarbon)] or a T unit [$RSiO_{3-1/2}$ (where R is a monovalent hydrocarbon)] may be contained. Also, a functional group such as an alkenyl group may be contained in a molecule.

Any method may be used to employ a material that is adhesive with respect to the back surface of a piece of transfer tape T as the material of the outer circumferential surface of the intermediate roller 8. If there is no problem regarding the slidability of the intermediate roller 8 within the coating film transfer tool, the entire intermediate roller 8 may be manufactured using an adhesive material. Also, only the outer circumferential surface of the intermediate roller 8 may be formed using an adhesive material. Methods through which only the outer circumferential surface of the intermediate roller 8 is formed using an adhesive material include a method through which the outer circumferential surface of the intermediate roller 8 is directly coated with an adhesive material, and a method through which a base material that is coated with an adhesive material is attached to the outer circumferential surface of the intermediate roller 8.

The adhesiveness of the outer circumferential surface of the intermediate roller 8 with respect to the back surface of a piece of transfer tape T can be measured as a peel force that acts when the back surface of the piece of transfer tape T and the outer circumferential surface of the intermediate roller 8 are peeled off from each other in a 180° direction, and this peel force is preferably greater than or equal to 2 mN/18 mm. If the peel force is below 2 mN/18 mm, the adhesion force (areal-contactability) between the outer circumferential surface of the intermediate roller 8 and the back surface of the piece of transfer tape T is insufficient, and the back surface of the piece of transfer tape T may be likely to slip on the outer circumferential surface of the intermediate roller 8. Also, if the piece of transfer tape T becomes loose, the piece of transfer tape T may be easily peeled off from the outer circumferential surface of the intermediate roller 8.

The upper limit of the 180° peel force that is applied to peel off the outer circumferential surface of the intermediate roller 8 from the back surface of the piece of transfer tape T may be set such that the piece of transfer tape T does not wrap around the intermediate roller 8 due to an excessively large peel force when the coating film transfer tool A is used. A typical tension of a piece of transfer tape T of a coating film transfer tool is 294 mN (30 gf) in the case of a piece of 5 mm-wide transfer tape, which will be 1058 mN/8 mm (108 gf/18 mm) when converted to the tension of a piece of 18 mm-wide transfer tape. Using a piece of adhesive tape with a strong adhesive force for fixing a car component or the like, the inventor of the present invention measured the 180° peel force of the piece of adhesive tape with respect to the back surface of a piece of transfer tape T, and the result was 127.4 mN/18 mm. Therefore, even when a generally available adhesive tape with a strong adhesive force is used as the outer circumferential surface of the intermediate roller 8, it is unlikely that a piece of transfer tape T wraps around the intermediate roller 8 due to a too large peel force. However, if the 180° peel force is greater than 100 mN/18 mm, a piece of transfer tape T may be peeled off at a position that is rearward of a position at which a piece of transfer tape T is usually peeled off from the intermediate roller. Therefore, it is preferable that the 180° peel force is no greater than 100 mN/18 mm. In many kinds of adhesive tape with a strong adhesive force, an adhesive is likely to be transferred onto an attachment target to which the adhesive tape is attached. If an adhesive moves to the back surface of a piece of transfer tape T, which is the attachment target according to the present invention, the transferred adhesive reaches the transfer head 4 as the piece of transfer tape T travels inside the coating film transfer tool A. If an adhesive reaches the transfer head 4, the adhesive may be retained in the leading portion of the transfer head 4, for example, and may cause a running failure of transfer tape T. If the aforementioned addition-curing silicone component is used as an adhesive, such an adhesive is not transferred to the back surface of a piece of transfer tape T. Also from such a viewpoint, it is preferable that the aforementioned addition-curing silicone component is used.

The 180° peel force of the outer circumferential surface of the intermediate roller 8 with respect to the back surface of a piece of transfer tape T can be measured through the method described below. Note that, in the following description, the adhesiveness of the outer circumferential surface of the intermediate roller 8 according to the present invention is represented by a value measured through the method described below.

Method for Measuring 180° Peel Force

A release sheet formed by applying a release agent for the back of a piece of transfer tape (correction tape) to a predetermined thickness on one side of a 12 μm-thick PET sheet, and a piece of adhesive tape that is to be attached to the outer circumferential surface of the intermediate roller in order to provide the outer circumferential surface of the intermediate roller with adhesiveness, are prepared. The 180° peel force that acts when the release surface of the release sheet (the back surface of a piece of transfer tape T) is peeled off from the adhesive surface of a piece of adhesive tape (the outer circumferential surface of the intermediate roller 8) is measured using a method for measuring a 180° peeling adhesive force defined in JIS Z0237 in which only a specimen size, an adhesion-target surface, and peeling speed are changed. That is to say, the back surface of a release sheet that has been cut to a width of 18 mm and a length of 200 mm, and the adhesive surface of a piece of adhesive tape, are attached and press-fitted to each other using a method defined in JIS 20237, and the 180° peel force is measured at a peeling speed of 51.1 mm/sec with the piece of adhesive tape being fixed.

Figure 2A:
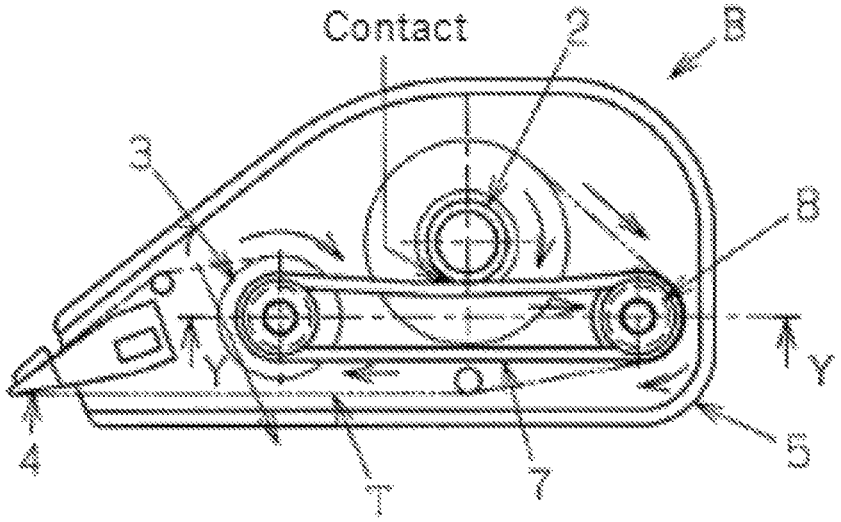
FIGS. 2A and 2B show a coating film transfer tool according to a second embodiment of the present invention.
Figure 2B:
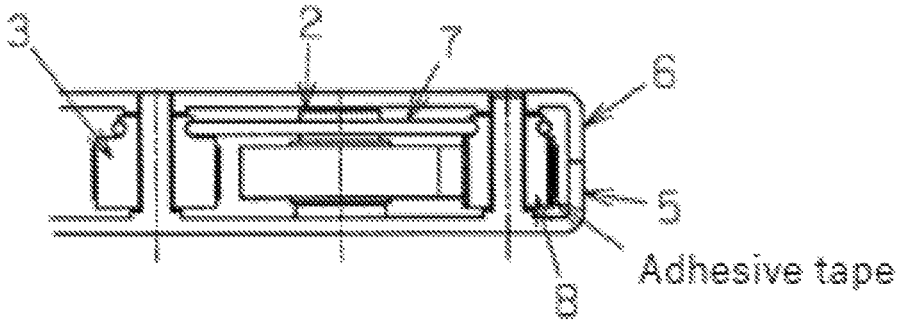
Figure 3A:
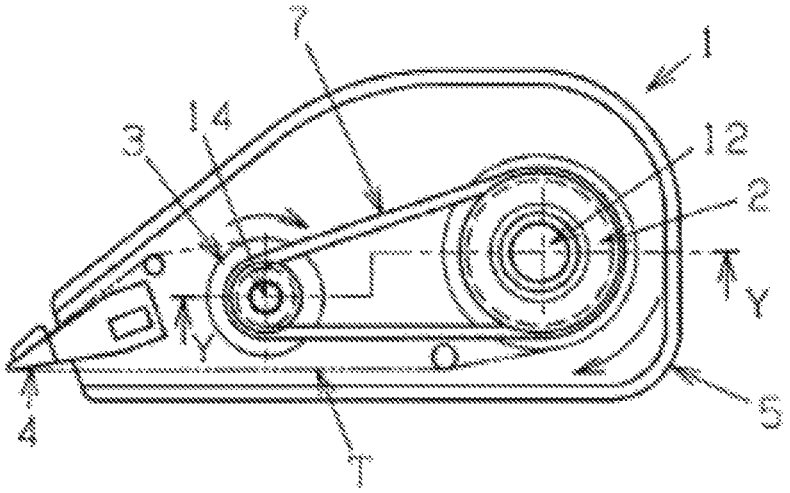
Fig.3A Prior art
FIGS. 3A and 3B show a conventional coating film transfer tool.
Figure 3B:
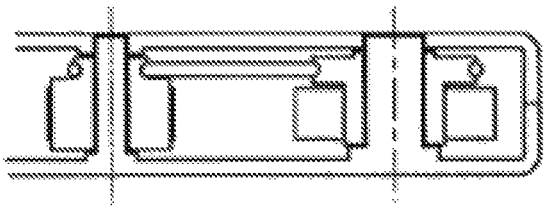
Fig.3B Prior art

FIGS. 2A and 2B show a coating film transfer tool B according to a second embodiment of the present invention. FIG. 2A is a front view showing a state in which a cover has been removed. FIG. 2A shows a state in an initial phase of usage in which transfer tape T wound around the feeding core 2 is unused and the outer diameter of the feeding pancake is large. FIG. 2B is a cross-sectional view taken along a line Y-Y in FIG. 2A. Note that FIG. 2B shows a state in which the cover is attached.

The coating film transfer tool B is the same as the coating film transfer tool A except that a pulley provided on the feeding core 2 is in contact with the belt 7. In the coating film transfer tool B, the pulley of the feeding core 2 and the belt 7 are in contact with each other, and therefore the feeding core 2 is less likely to rotate compared to in the coating film transfer tool A, despite a brake member for braking the rotation of the feeding core 2 being not provided. Therefore, it is less likely that a piece of transfer tape T is fed from the feeding core 2 due to vibrations applied to the coating film transfer tool B in an unused sate, for example, and it is less likely that a piece of transfer tape T becomes loose.

In the coating film transfer tool B, the belt 7 moves along a circulation path around the pulley of the intermediate roller 8 and the pulley of the winding core 3. As a result of the belt 7 moving, the rotation of the intermediate roller 8 is transmitted to the winding core 3 and the winding core 3 rotates, and a piece of base tape remaining after a coating film has been transferred from the piece of transfer tape T at the transfer head 4 is wound up by the winding core 3. The belt 7 is in contact with the feeding core 2 while moving along this circular path. The direction in which the belt 7 travels at the position of contact with the feeding core 2 is the direction in which the feeding core 2 rewinds the piece of transfer tape T.

Therefore, in the coating film transfer tool B, when a coating film is transferred from the transfer tape T at the transfer head 4, the feeding core 2 is rotating in the direction of feeding the piece of transfer tape T, and is also in contact with the belt 7 that travels in the direction in which the feeding core 2 rewinds the piece of transfer tape T. In the coating film transfer tool B, from the initial phase of usage to the final phase of usage, the moment that acts on the feeding core 2 due to the belt 7 coming into contact therewith is set so as to be sufficiently smaller than the moment that acts on the feeding core 2 due to the piece of transfer tape T being drawn out by the transfer head 4. Therefore, there is no possibility that it will be difficult to transfer a coating film due to the tension of the piece of transfer tape T becoming large.

As described above, in the coating film transfer tool B, the feeding core 2 when a coating film is transferred is subjected to an external force applied by a piece of transfer tape T in the direction in which the piece of transfer tape T is fed, and an external force applied by the belt 7 in the direction in which the transfer tape T is rewound. If the piece of transfer tape T fed from the feeding core 2 is not loose, the moment in the direction in which the transfer tape T is fed is set so as to be sufficiently large relative to the moment in the direction in which the piece of transfer tape T is rewound. Therefore, the feeding core 2 does not rotate in the direction in which the piece of transfer tape T is rewound.

In the coating film transfer tool B, as in the coating film transfer tool A, the outer circumferential surface of the intermediate roller 8 is adhesive to the back surface of the transfer tape T. Therefore, even when the piece of transfer tape T becomes loose between the feeding core 2 and the intermediate roller 8, the state in which the outer circumferential surface of the intermediate roller 8 and the back surface of the transfer tape T are in contact with each other is maintained, and the looseness of the piece of transfer tape T does not affect an area near the transfer head 4 beyond the intermediate roller 8. Also in the coating film transfer tool A, the back surface of the transfer tape T adheres to the outer circumferential surface of the intermediate roller 8. Therefore, upon the transfer of a coating film being started at the transfer head 4, the intermediate roller 8 immediately starts rotating, and the looseness of the piece of transfer tape T between the feeding core 2 and the intermediate roller 8 will be eliminated. In the coating film transfer tool B, upon the transfer of a coating film being started at the transfer head 4, the feeding core 2 is rotated by the belt 7 in the direction in which the piece of transfer tape T is rewound because the piece of transfer tape T is loose between the feeding core 2 and the intermediate roller 8. Therefore, in the coating film transfer tool B, even if the piece of transfer tape T becomes loose between the feeding core 2 and the intermediate roller 8, the looseness of the piece of transfer tape T is eliminated due to both the feeding core 2 and the intermediate roller 8 rotating to transfer a coating film, and the looseness of the piece of transfer tape T is more swiftly eliminated than in the coating film transfer tool A. Therefore, in the coating film transfer tool B, a running failure of the transfer tape T caused by the looseness of a piece of transfer tape T is more reliably prevented than in the coating film transfer tool A.

As described above, in the coating film transfer tool B, the feeding core 2 is also in contact with the belt 7, the feeding core 2 is unlikely to rotate and a piece of transfer tape T is unlikely to become loose despite a special brake member for braking the rotation of the feeding core 2 being not provided. However, if the feeding pancake (in which transfer tape T is wound around the feeding core 2) is heavy particularly because the piece of transfer tape T wound around the feeding core 2 is long or wide, a brake member for braking the rotation of the feeding core 2 may be supplementarily provided. However, it is preferable that a load that is applied to brake the feeding core 2 is as low as possible. As the force with which the brake presses the feeding core 2 increases, the tension of the piece of transfer tape T increases. If the tension of the piece of transfer tape T is too large, it is necessary to press the transfer head 4 against the transfer target surface with a large pressing force to transfer a coating film to the transfer target surface, which degrades the usability of the coating film transfer tool B. Therefore, it is preferable that the pressing force with which the brake presses the feeding core 2 is as small as possible.

The brake member may be realized using a resin spring that is provided integrally with the cover or the case, or a metal disc spring or coil spring.

In the coating film transfer tools A and B described above, an intermediate roller that rotates as a piece of transfer tape travels is provided such that the intermediate roller and the winding core rotate in conjunction with each other. Therefore, in the coating film transfer tools A and B, the degree to which a change in the outer diameter of the feeding pancake (in which transfer tape is wound around the feeding core) affects the tension of the transfer tape is smaller, and it is possible to reduce the difference in the tension of a piece of transfer tape in the initial phase of usage and in the final phase of usage. In the coating film transfer tools A and B, the surface of the intermediate roller that comes into contact with the piece of transfer tape is adhesive with respect to the surface of the piece of transfer tape on which a coating film is not provided, such that the peel force that is required when these surfaces attached to each other are peeled off from each other is greater than or equal to a specific value (2 mN/18 mm). Therefore, the surface of the piece of transfer tape on which a coating film is not provided is attached to the intermediate roller, and even if the piece of transfer tape becomes loose between the feeding core and the intermediate roller, such looseness does not affect a piece of transfer tape near the transfer head beyond the intermediate roller. Therefore, there is a very low possibility that the piece of transfer tape will become loose near the transfer head and cause a running failure. Therefore, even if the rotational resistance of the feeding pancake is reduced and a change in the tension of a piece of transfer tape between the initial phase of usage and the final phase of usage is reduced, there is a very low possibility that the piece of transfer tape will cause a running failure.

In the coating film transfer tools A and B described above, it is possible to reduce a change in usability, i.e., the ease of use, between the initial phase of usage and the final phase of usage, by reducing the rotational resistance of the feeding pancake to a very low level, without employing a complex structure. Also, it is possible to prevent a transfer failure from occurring due to an increase in the tension of a piece of transfer tape in the final phase of usage. In addition, the surface of the piece of transfer tape on which a coating film is not provided is kept in the state of adhering to the intermediate roller. Therefore, there is a very low possibility that a running failure of the piece of transfer tape will occur due to the rotational resistance of the feeding pancake reduced to a very low level.

That is to say, it is possible to suppress a change in the tension of a piece of transfer tape from the initial phase of usage to the final phase of usage, without employing a complex structure. As a result, a change in the ease of use from the initial phase of usage to the final phase of usage is small, and it is possible to prevent a transfer failure from occurring due to an increase in the tension of a piece of transfer tape in the final phase of usage. Furthermore, there is a very low possibility that a running failure of a piece of transfer tape will occur due to the piece of transfer tape becoming loose.

EXAMPLES

The coating film transfer tool A according to the first embodiment of the present invention shown in FIG. 1 was prepared as Example 1 of the present invention. In the coating film transfer tool A, the outer circumferential surface of the intermediate roller 8 was made adhesive by attaching an adhesive sheet A11 to the outer circumferential surface of the intermediate roller 8. The adhesive sheet A11 is an adhesive sheet formed by providing a silicone adhesive layer that is mainly composed of addition-curing silicone and has a thickness of 20 μm on one surface of a PET sheet that has a thickness of 50 rpm, and providing a layer of an acrylic adhesive that has a thickness of 20 μm on the other surface of the PET sheet. In the coating film transfer tool A, the acrylic adhesive on the adhesive sheet A11 is attached to the outer circumferential surface of the intermediate roller 8, and therefore the silicone adhesive layer of the adhesive sheet A11 forms the outer circumferential surface of the intermediate roller 8. Therefore, when the intermediate roller 8 is built into the coating film transfer tool A, the silicone adhesive layer is exposed from the entire surface that comes into contact with a piece of transfer tape T. The 180° peel force of the outer circumferential surface of the intermediate roller 8 of the coating film transfer tool A and the back surface of a piece of transfer tape was as shown in Tables 1 and 2.

Coating film transfer tools A2, A3, and A4 were prepared as Examples 2, 3, and 4. The configurations of the coating film transfer tools A2, A3, and A4 are the same as the configuration of the coating film transfer tool A except that the adhesive sheet A11 of the coating film transfer tool A is replaced with adhesive sheets A21, A31, and A41, respectively. The configurations of the adhesive sheets A21. A31, and A41 are the same as the configuration of the adhesive sheet A11 except that the 180° peel force thereof with respect to the back surface of a piece of transfer tape is made greater than that of the adhesive sheet A11 by adding an MQ resin to the silicone adhesive in the silicone adhesive layer of the adhesive sheet A11. The 180° peel force of the outer circumferential surfaces of the intermediate rollers 8 of the coating film transfer tools A2, A3, and A4 and the back surface of a piece of transfer tape were as shown in Tables 1 and 2.

Coating film transfer tools A5 and A6 were prepared as Examples 5 and 6. The configurations of the coating film transfer tools A5 and A6 are the same as the configuration of the coating film transfer tool A except that a piece of double-sided adhesive tape "double face" (registered trademark) DT-831204, manufactured by TOYOCHEM CO., LTD, and a piece of double coated cloth tape NO. 5320, manufactured by Maxell, Ltd., which are commercially available double-sided tape, are attached to the outer circumferential surface of the intermediate roller 8 as pieces of adhesive tape A51 and A61, respectively. In the coating film transfer tool A6, the diameter of the outer circumferential surface of the intermediate roller 8 was adjusted before attaching a piece of double-sided tape thereto, such that the diameter of the outer circumferential surface of the intermediate roller 8 would be the same as the diameter of the outer circumferential surface of the intermediate roller 8 of the coating film transfer tool A after attaching a piece of double-sided tape thereto. The 180° peel force of the outer circumferential surfaces of the intermediate rollers 8 of the coating film transfer tools A5 and A6 and the back surface of a piece of transfer tape were as shown in Tables 1 and 2.

Coating film transfer tools B and B2 to B6 were prepared as Examples 7 to 12. The configurations of the coating film transfer tools B and B2 to B6 are respectively the same as the configurations of Examples 1 to 6 except that the belt 7 is configured to come into contact with the pulley of the feeding core 2 as in the second embodiment of the present invention.

A coating film transfer tool C was prepared as Example 13. The configuration of the coating film transfer tool C is the same as the configuration of the coating film transfer tool A except that a metal disc spring is provided between the feeding core and the cover of the coating film transfer tool A according to Example 1 such that a brake toque of 0.3 N·cm is applied to the feeding core.

A coating film transfer tool a was prepared as Comparative Example 1. The configuration of the coating film transfer tool a is the same as the configuration of the coating film transfer tool A except that an adhesive sheet is not attached to the outer circumferential surface of the intermediate roller and the material (polyacetal: POM) of the intermediate roller is left unchanged.

A coating film transfer tool b was prepared as Comparative Example 2. The coating film transfer tool b is formed by removing the intermediate roller from the coating film transfer tool A and attaching the feeding core to the same position as the intermediate roller, and is configured such that the feeding core and the winding core are rotated in conjunction with each other using a belt that is the same as the belt used in the coating film transfer tool A. The other components are the same those in the coating film transfer tool A. Note that the pulley of the intermediate roller of the coating film transfer tool A and the pulley member of the feeding core of the coating film transfer tool b are made of the same material and have the same shape.

A coating film transfer tool c was prepared as Comparative Example 3. The configuration of the coating film transfer tool c is the same as the configuration of the coating film transfer tool a except that a metal disc spring is provided between the feeding core and the cover of the coating film transfer tool a of Comparative Example 1 such that a brake toque of 0.3 N·cm is applied to the feeding core.

Evaluation was performed from the following points of view, using coating film transfer tools according to Examples 1 to 13 and Comparative Examples 1 to 3.

(1) The Tension of a Piece of Transfer Tape T in the Initial Phase of Usage

Figure 6:
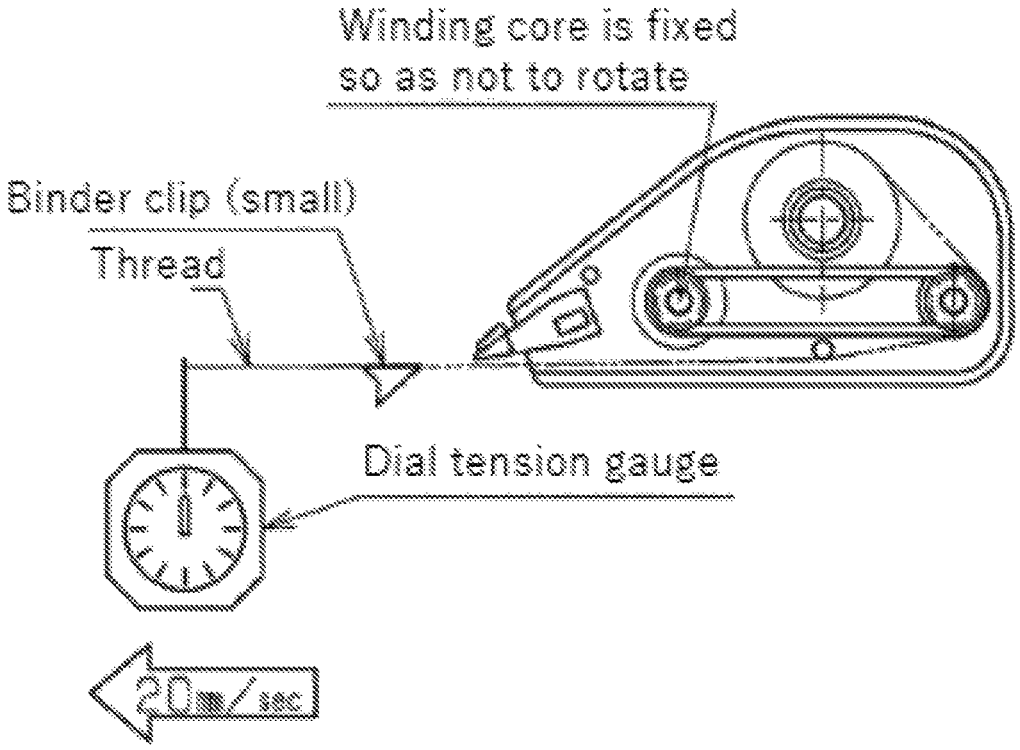
FIG. 6 is a diagram showing a method for measuring tension of a piece of transfer tape T.

As shown in FIG. 6, a piece of transfer tape T was drawn out from the coating film transfer tool, the piece of transfer tape T and a dial tension gauge were coupled to each other using a thread and a binder clip (small), with the piece of transfer tape T coupled to the winding core being sufficiently loose and with the winding core 3 fixed so as not to rotate, the dial tension gauge was moved at 20 mm/sec, and the tension of the piece of transfer tape T when the piece of the transfer tape T was fed from the feeding core. DTN-50 manufactured by TECLOCK Co., Ltd was used as the dial tension gauge. The results of the evaluations are shown in Table 1.

Figure 7A:
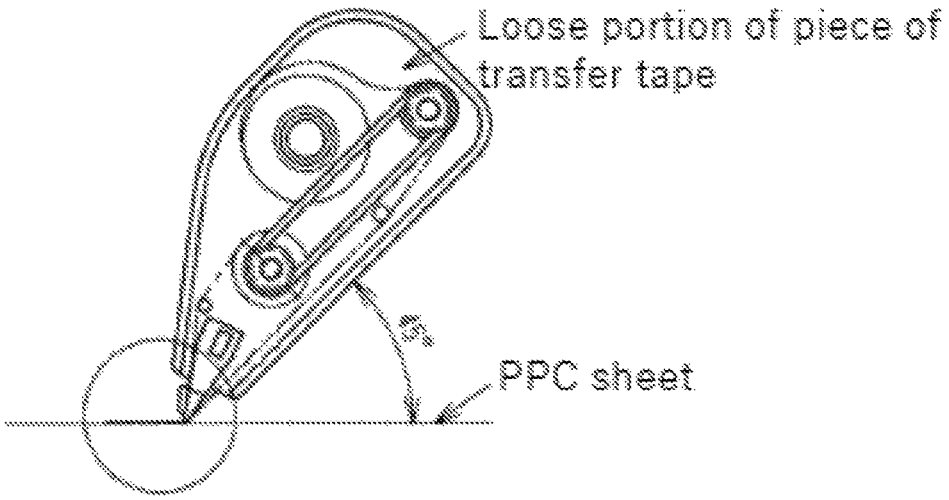
FIGS. 7A-7C are diagrams showing a piece of transfer tape jutting out from a leading end of a transfer head.
Figure 7B:
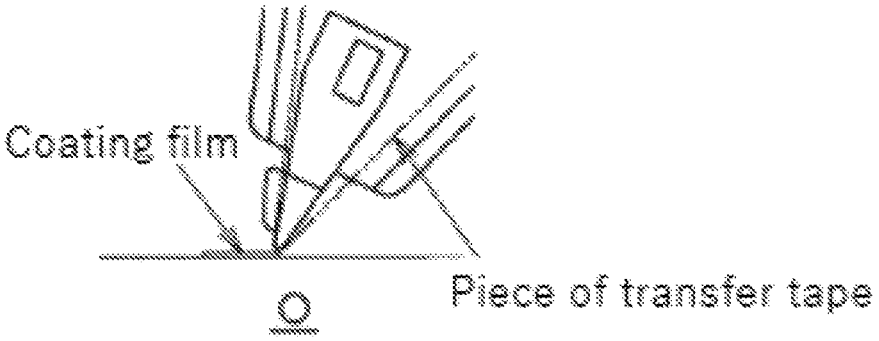
Figure 7C:
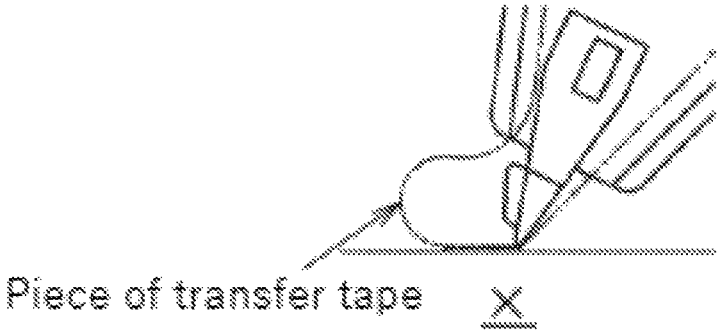

(2) The Influence of Looseness of a Piece of Transfer Tape Between the Feeding Core and the Intermediate Roller, on the Transfer of a Coating Film As shown in FIG. 7A, after a loose portion of 1 cm was formed in a piece of transfer tape between the feeding core and the intermediate roller, a coating film was transferred onto a transfer target (a PPC sheet) placed on a horizontal surface, and whether or not a loose portion of the piece of transfer tape T jutted out from the leading end of the transfer head as shown in FIG. 7C was visually checked. Evaluation was performed five times for each coating film transfer tool. The number of times a piece of transfer tape became loose and jutted out form the leading end of the transfer head is shown in Table 1.

(3) Elimination of the Looseness of a Piece of Transfer Tape Between the Feeding Core and the Intermediate Roller As in item (2), after a loose portion of 1 cm was formed in a piece of transfer tape between the feeding core and the intermediate roller, a 5 mm long coating film was transferred onto a transfer target (a PPC sheet) placed on a horizontal surface. After the transfer, the presence or absence of a loose portion of the piece of transfer tape between the feeding core and the intermediate roller was visually checked. If a loose portion was still present, a 1 cm long coating film was additionally transferred. Evaluation was performed using coating film transfer tools according to Examples 1 to 13 and Comparative Examples 1 and 3. The results of evaluation are shown in Table 1.

I: The looseness of the piece of transfer tape had been eliminated when a 5 mm long coating film was transferred.

II: The looseness of the piece of transfer tape had not been eliminated when a 5 mm long coating film was transferred, but the looseness of the piece of transfer tape had been eliminated when a 1 cm long coating film was additionally transferred.

IV: The looseness of the piece of transfer tape had not been eliminated when a 5 mm long coating film was transferred and thereafter a 1 cm long coating film was additionally transferred.

Figure 9A:
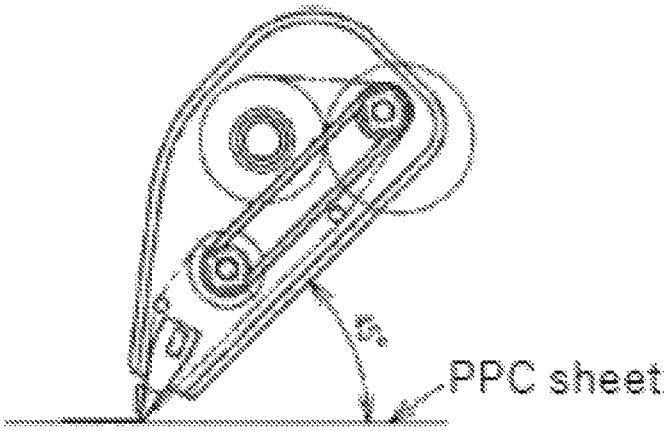
FIGS. 9A-9C are diagrams showing a method for checking a state of a piece of transfer tape peeled off from an intermediate roller.
Figure 9B:
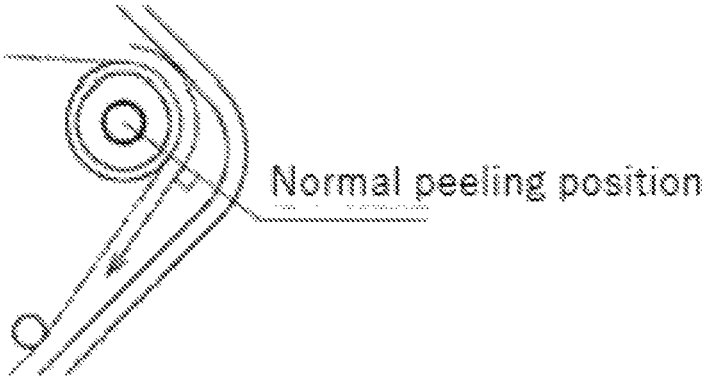
Figure 9C:
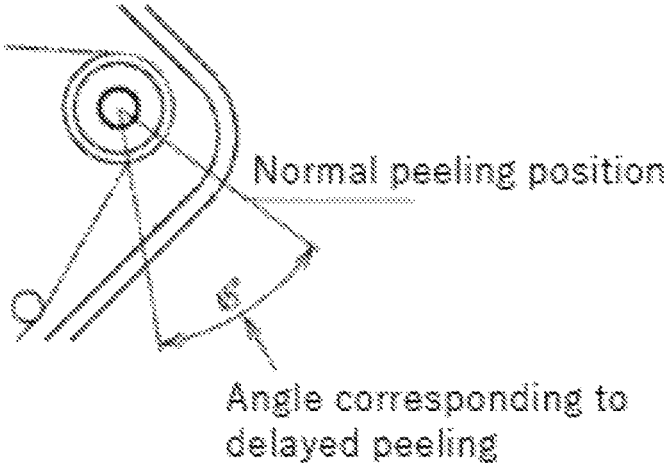

(4) The State of a Piece of Transfer Tape Peeled Off from the Intermediate Roller Coating film transfer tools in the initial phase of usage, in which the outer diameter of the pancake of transfer tape T wound around the feeding core was at its maximum (the diameter of the pancake: 22.5 mm), were used. A 30 cm long piece of transfer tape was transferred at a transfer speed of 300 mm/sec in a state in which the user held a coating film transfer tool in their hand, and the peeling position at which the piece of transfer tape was peeled off from the intermediate roller 8 was visually checked. Regarding a coating film transfer tool in which a piece of transfer tape was peeled off with a delay from a normal position at which a piece of transfer tape is usually peeled off from the intermediate roller, the central angle with respect to the intermediate roller, formed by the normal position and the peeling position (an angle corresponding to delayed peeling), was measured as shown in FIG. 9C, using measuring microscope MM-800 manufactured by Nikon Corporation. Evaluation was performed ten times for each coating film transfer tool, and the peeling position of a piece of transfer tape was visually checked each time the transfer was complete. Evaluation was performed using coating film transfer tools according to Examples 1 to 13 and Comparative Examples 1 and 3. The results of evaluation are shown in Table 1.

I: A piece of transfer tape was peeled off from the intermediate roller at the normal position in all of the ten evaluations.

II: Although peeling was delayed in at least one evaluation, the central angle between the normal position and the peeling position (an angle corresponding to delayed peeling) was no greater than 0.52 radians (30 degrees) in all of the evaluations.

IV: Peeling was delayed in at least one evaluation, and the central angle between the normal position and the peeling position (an angle corresponding to delayed peeling) was greater than 0.52 radians (30 degrees) in at least one of the evaluations.

(5) The Degree of Ease of Cutting a Coating Film in the Initial Phase of Usage

Figure 4A:
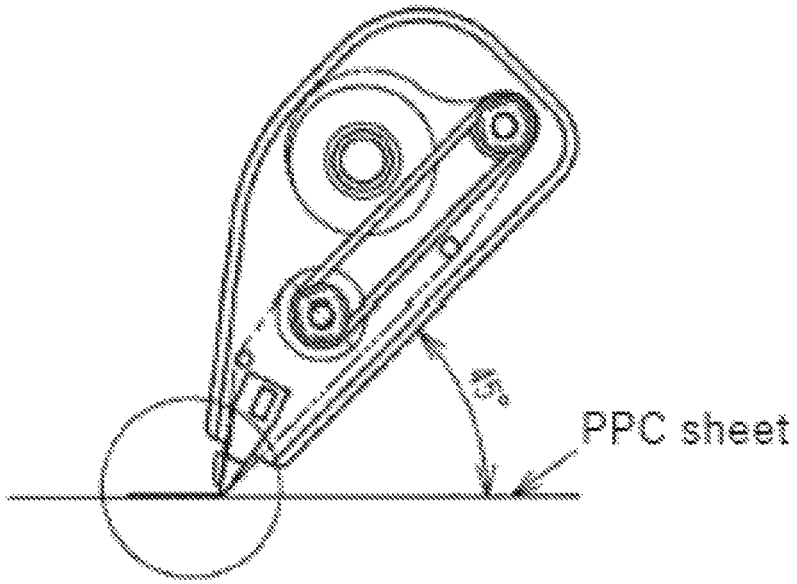
FIGS. 4A-4C are schematic diagrams showing the degree of ease of cutting a transfer coating film.

A coating film was transferred onto a transfer target (a PPC sheet) at the angle shown in FIG. 4A, and the degree of ease of cutting the coating film when the coating film transfer tool was lifted from the transfer target was visually evaluated according to the following determination criteria. The results of evaluation are shown in Table 1.

Figure 4B:
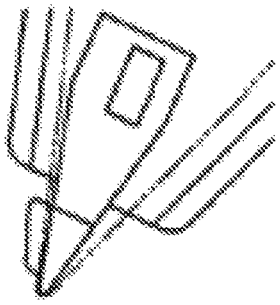

II: The coating film was desirably cut as shown in FIG. 4B.

Figure 4C:
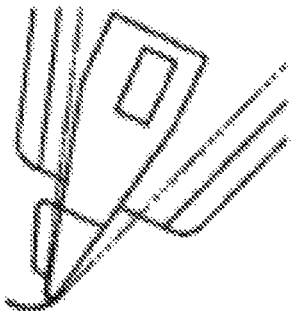

IV: The coating film could not be easily cut and a coating film that was peeled off jutted from the piece of transfer tape as shown in FIG. 4C.

(6) Measurement of Transfer Pressure

Figure 5:
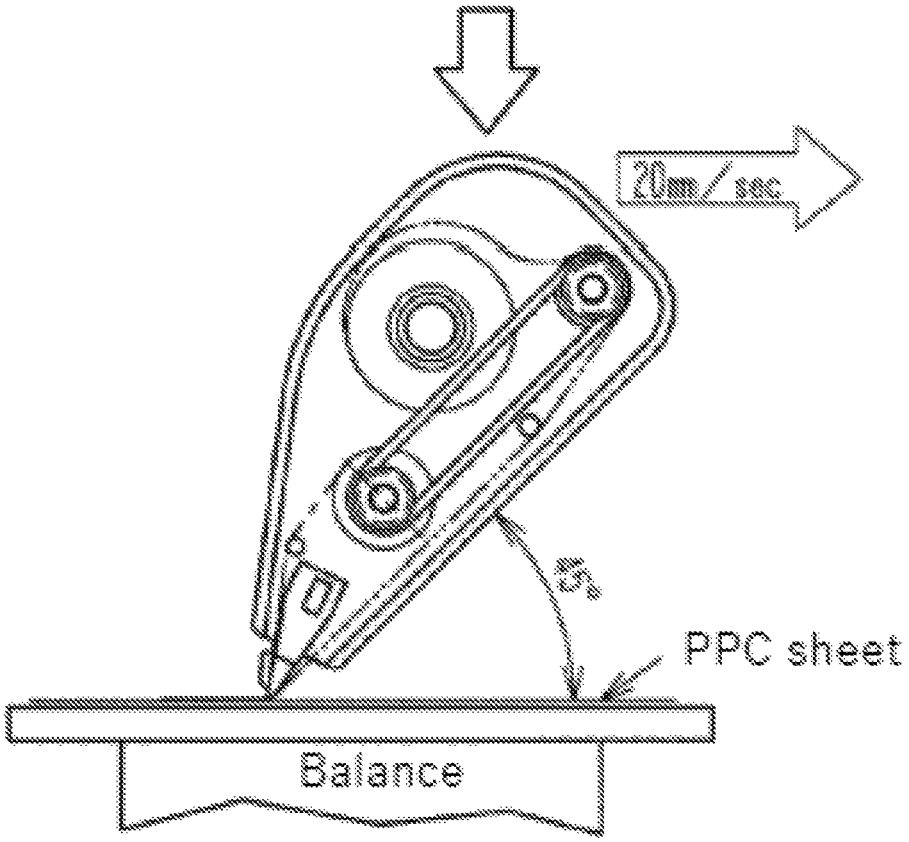
FIG. 5 is a diagram showing a usage state (an angle) of a coating film transfer tool when a transfer pressure was measured.

The transfer pressure applied by the transfer head when a coating film was transferred onto a transfer target (a PPC sheet) at the angle shown in FIG. 5 was measured using a balance having a platform. The results of the evaluations are shown in Table 2. Measurement was performed at two points in time respectively in the initial phase of usage and the final phase of usage. Here, a transfer pressure indicates the minimum required load with which the transfer head is pressed against the transfer target in order to draw out a piece of transfer tape. Note that a coating film (having a length of approximately 2 mm) of a piece of transfer tape pressed by the transfer head was peeled off, and when transfer was started, a piece of transfer tape without a coating film was pressed against the transfer target, and thus the transfer pressure was measured.

(7) The Transfer Running Performance of a Piece of Transfer Tape

The entire length (5 m) of transfer tape was transferred at a transfer speed of 50 mm/sec in the state of being held in the user's hand, and the transfer running performance of transfer tape was evaluated. The results of the evaluations are shown in Table 2.

II: The running performance of transfer tape was stable throughout the entire length thereof.

III: The travel of transfer tape was temporarily unstable, e.g. a piece of transfer tape became loose in the initial phase of usage, or a piece of transfer tape could not be easily fed in the final phase of usage.

IV: the running performance of transfer tape was unstable throughout the entire length thereof.

(8) The Free Tension (Tension) of the Feeding Core (Pancake)

Figure 8:
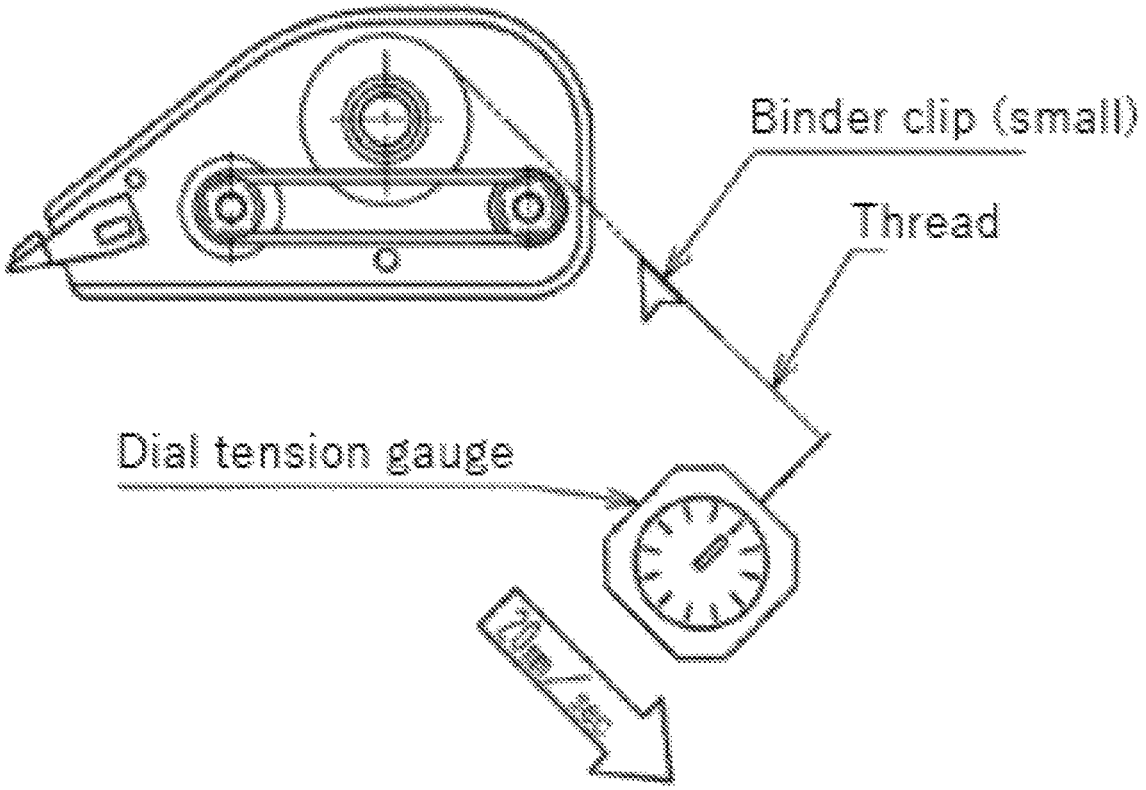
FIG. 8 is a diagram showing a method for measuring free tension of a feeding core (a pancake).

The tension that was required when a piece of transfer tape was drawn out directly from the feeding core was measured using coating film transfer tools according to Example 1 and 7 to 12 as shown in FIG. 8. A piece of transfer tape T was drawn out from a coating film transfer tool in the direction shown in the figure, the piece of transfer tape T and a dial tension gauge were coupled to each other using a thread and a binder clip (small), and the tension of the piece of transfer tape T when the piece of transfer tape T was fed from the feeding core was measured while the dial tension gauge was being moved at 20 mm/sec. DTN-50 manufactured by TECLOCK Co., Ltd was used as the dial tension gauge. The results of the evaluations are shown in Table 2.

TABLE 1

| | Coating Film Transfer Tool | Adhesive Tape | 180° Peel Force of Outer Circumferential Surface of Intermediate Roller and Back Surface of Piece of Transfer Tape (mN/18 mm) | Results of Evaluations | | | | |
|---|---|---|---|---|---|---|---|---|
| | | | | (1) Tension (mN) of Piece of Transfer Tape T in Initial Phase of Usage | (2) Influence of Looseness of Piece of Transfer Tape between Feeding Core and Intermediate Roller, on Transfer of Coating Film Number of Times Loose Portion Jutted (Times/5 Times) | (3) Elimination of Looseness of Piece of Transfer Tape between Feeding Core and Intermediate Roller | (4) State of Piece of Transfer Tape Peeled Off From Intermediate Roller | 15) Degree of Ease of Cutting Coating Film in Initial Phase of Usage |
| Example 1 | Coating Film Transfer Tool A | A11 | 2.2 | 392 | 0 | II | I | II |
| Example 2 | Coating Film Transfer Tool A2 | A21 | 21.6 | 392 | 0 | II | I | II |
| Example 3 | Coating Film Transfer Tool A3 | A31 | 53.9 | 392 | 0 | II | I | II |
| Example 4 | Coating Film Transfer Tool A4 | A41 | 89.2 | 392 | 0 | II | I | II |
| Example 5 | Coating Film Transfer Tool A5 | A51 | 29.4 | 392 | 0 | II | I | II |
| Example 6 | Coating Film Transfer Tool A6 | A61 | 127.4 | 392 | 0 | II | II | II |
| Example 7 | Coating Film Transfer Tool B | A11 | 2.2 | 441 | 0 | I | I | II |
| Example 8 | Coating Film Transfer Tool B2 | A21 | 21.6 | 441 | 0 | I | I | II |
| Example 9 | Coating Film Transfer Tool B3 | A31 | 53.9 | 441 | 0 | I | I | II |
| Example 10 | Coating Film Transfer Tool B4 | A41 | 89.2 | 441 | 0 | I | I | II |
| Example 11 | Coating Film Transfer Tool B5 | A51 | 29.4 | 441 | 0 | I | I | II |
| Example 12 | Coating Film Transfer Tool B6 | A61 | 127.4 | 441 | 0 | I | II | II |
| Example 13 | Coating Film Transfer Tool C | A11 | 2.2 | 588 | 0 | II | I | II |
| Comparative Example 1 | Coating Film Transfer Tool a | | | 58.8 | 5 | IV | I | IV |
| Comparative Example 2 | Coating Film Transfer Tool b | | | 441 | 5 | | | II |
| Comparative Example 3 | Coating Film Transfer Tool c | | | 490 | 5 | IV | I | IV |

TABLE 2

| | Coating Film Transfer Tool | Adhesive Tape | 180° Peel Force of Outer Circumferential Surface of Intermediate Roller and Back Surface of Piece of Transfer Tape (mN/18 mm) | Results of Evaluations (6) Transfer Pressure (N) Initial Phase of Usage | Final Phase of Usage | (Increase Ratio = Final Phase of Usage/Initial Phase of Usage) | (7) Evaluation of Transfer Running performance of Piece of Transfer Tape | (8) Free Tension (Tension) (mN) of Feeling Core (Pancake) |
|---|---|---|---|---|---|---|---|---|
| Example 1 | Coating Film Transfer Tool A | A11 | 2.2 | 3.1 | 3.1 | 1.0 | II | 19.6 |
| Example 2 | Coating Film Transfer Tool A2 | A21 | 21.6 | 3.1 | 3.1 | 1.0 | II | |
| Example 3 | Coating Film Transfer Tool A3 | A31 | 53.9 | 3.1 | 3.1 | 1.0 | II | |
| Example 4 | Coating Film Transfer Tool A4 | A41 | 89.2 | 3.1 | 3.1 | 1.0 | II | |
| Example 5 | Coating Film Transfer Tool A5 | A51 | 29.4 | 3.1 | 3.1 | 1.0 | II | |
| Example 6 | Coating Film Transfer Tool A6 | A61 | 127.4 | 3.1 | 3.1 | 1.0 | II | |
| Example 7 | Coating Film Transfer Tool B | A11 | 2.2 | 3.6 | 3.6 | 1.0 | II | 49.0 |
| Example 8 | Coating Film Transfer Tool B2 | A21 | 21.6 | 3.6 | 3.6 | 1.0 | II | 49.0 |
| Example 9 | Coating Film Transfer Tool B3 | A31 | 53.9 | 3.6 | 3.6 | 1.0 | II | 49.0 |
| Example 10 | Coating Film Transfer Tool B4 | A41 | 89.2 | 3.6 | 3.6 | 1.0 | II | 49.0 |
| Example 11 | Coating Film Transfer Tool B5 | A51 | 29.4 | 3.6 | 3.6 | 1.0 | II | 49.0 |
| Example 12 | Coating Film Transfer Tool B6 | A61 | 127.4 | 3.6 | 3.6 | 1.0 | II | 49.0 |
| Example 13 | Coating Film Transfer Tool C | A11 | 2.2 | 3.1 | 5.3 | 1.7 | II | |
| Comparative Example 1 | Coating Film Transfer Tool a | | | No Greater Than 1 | * | * | IV | |
| Comparative Example 2 | Coating Film Transfer Tool b | | | 3.1 | 6.1 | 2.0 | II | |
| Comparative Example 3 | Coating Film Transfer Tool c | | | 3.1 | * | * | IV | |

* A piece of transfer tape could not be wound up in Comparative Examples 1 and 3, and therefore item (6) was evaluated only regarding the initial phase of usage.

The results of the evaluations are as shown in Tables 1 and 2. In the coating film transfer tools according to Examples 1 to 12, a change in the transfer pressure from the initial phase of usage to the final phase of usage is smaller than in the coating film transfer tool according to Comparative Example 2, which is a conventional coating film transfer tool. As a result, the ease of use did not change throughout the period from the initial phase of usage to the final phase of usage, and it was easy to perform coating film transfer. In the coating film transfer tool according to Example 13, the transfer pressure was greater than that in the coating film transfer tools according to Examples 1 to 12. However, a change in the transfer pressure from the initial phase of usage to the final phase of usage was smaller than that in the coating film transfer tool according to Comparative Example 2, and it was easy to perform coating film transfer. Also, in the coating film transfer tools according to Examples 1 to 13, even when a portion of a piece of transfer tape was made loose near the feeding core, such a loose portion did not jut out from the transfer head, and was immediately eliminated through transfer. In particular, such a loose portion was more immediately eliminated in the coating film transfer tools according to Examples 7 to 12. In contrast, in the coating film transfer tools according to Comparative Examples 1 and 3, when a portion of a piece of transfer tape was made loose near the feeding core, such a loose portion jutted out from the transfer head through coating film transfer, and caused a transfer failure. In the coating film transfer tools according to Comparative Examples 1 and 3, such a loose portion was not eliminated through transfer.

LIST OF REFERENCE NUMERALS

1, Z, A, B, A2 to A6, B2 to B6, C, a, b, c: Coating Film Transfer Tool
2: Feeding Core
3: Winding Core
4: Transfer Head
5: Case
6: Cover
7: Belt
8: Intermediate Roller
12, 14: Spindle
T: Transfer Tape
A11, A21, A31, A41, A51, A61: Adhesive Sheet

The invention claimed is:

1. A coating film transfer tool comprising:

a feeding core around which transfer tape is wound and configured to feed a piece of transfer tape, the piece of transfer tape including a piece of base tape and a coating film that is provided on one surface of the piece of base tape;

a transfer head configured to press the coating film against a transfer target and transfers the coating film thereonto;

a winding core configured to wind up the piece of base tape from which the coating film has been transferred; and an intermediate roller configured to rotate as the piece of transfer tape travels, in contact with a surface of the piece of transfer tape fed from the feeding core, the surface of the piece of transfer tape being a surface on which the coating film is not provided, wherein an outer circumferential surface of the intermediate roller is adhesive with respect to the surface of the piece of transfer tape, the outer circumferential surface of the intermediate roller being a surface that comes into contact with the piece of transfer tape wherein a 180° peel force of the surface of the piece of transfer tape and the outer circumferential surface of the intermediate roller is greater than or equal to 2 mN/18 mm.

2. The coating film transfer tool according to claim 1, further comprising a belt that is wound around the intermediate roller and the winding core, wherein the piece of base tape from which the coating film has been transferred is wound up by the winding core upon the intermediate roller and the winding core rotating in conjunction with each other due to the belt.

3. The coating film transfer tool according to claim 2, wherein the belt is in contact with the feeding core, and the belt is configured to move in a direction opposite to a direction in which the feeding core moves, at a position where the belt is in contact with the feeding core, due to the coating film being transferred by the transfer head onto the transfer target.

* * * * *